US010498080B2

(12) United States Patent
Zhang et al.

(10) Patent No.: US 10,498,080 B2
(45) Date of Patent: Dec. 3, 2019

(54) ELECTRICAL CONNECTOR

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Guo-Hua Zhang, Kunshan (CN); Ling-Jie Meng, Kunshan (CN); Xiao-Bo Du, Kunshan (CN); Chun-Ming Yu, Kunshan (CN); Er-Dong Ma, Kunshan (CN)

(73) Assignees: FOXCONN (KUNSHAN) COMPUTER CONNECTOR Co., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/222,535

(22) Filed: Dec. 17, 2018

(65) Prior Publication Data

US 2019/0190202 A1 Jun. 20, 2019

(30) Foreign Application Priority Data

Dec. 15, 2017 (CN) ..... 2017 1 1343447

(51) Int. Cl.

| | |
|---|---|
| ***H01R 13/631*** | (2006.01) |
| ***H01R 13/502*** | (2006.01) |
| ***H01R 13/52*** | (2006.01) |
| ***H01R 12/61*** | (2011.01) |
| ***H01R 12/59*** | (2011.01) |

(52) U.S. Cl.

CPC ..... *H01R 13/631* (2013.01); *H01R 12/592* (2013.01); *H01R 12/61* (2013.01); *H01R 13/502* (2013.01); *H01R 13/521* (2013.01)

(58) Field of Classification Search

CPC H01R 12/716; H01R 12/724; H01R 12/5213; H01R 13/5202

USPC ..... 439/76.1, 79, 660, 589

See application file for complete search history.

(56) References Cited

U.S. PATENT DOCUMENTS

| | | | | |
|---|---|---|---|---|
| 5,503,572 A * | 4/1996 | White | ..... | H01R 4/2433 439/676 |
| 7,826,232 B2 * | 11/2010 | Von Arx | ..... | H01R 13/514 361/788 |
| 9,577,361 B2 * | 2/2017 | Benner | ..... | H01R 4/5083 |
| 9,966,692 B2 * | 5/2018 | Yamachika | ..... | H01R 12/58 |

FOREIGN PATENT DOCUMENTS

CN 107293896 A 10/2017

* cited by examiner

*Primary Examiner* — Hien D Vu

(74) *Attorney, Agent, or Firm* — Wei Te Chung; Ming Chieh Chang

(57) ABSTRACT

A electrical connector includes an insulative housing having a mating face and a loading face opposite to each other. A plurality of partitions are formed in the housing with corresponding passageways in which a plurality of contacts are received. The partition includes a main body and a protrusion extending on the loading face. The protrusion includes a pair of chamfers with a recess in one side to receive the possible burrs due to the injection molding so as to allow the sealing plate intimately cover the loading face with superior waterproofing effect.

9 Claims, 6 Drawing Sheets

ELECTRICAL CONNECTOR

FIELD OF THE INVENTION

The invention relates to the electrical connector assembly, particularly to the electrical connector used in a sliding track structure.

DESCRIPTION OF RELATED ART

China Patent No. CN107293896 discloses an electrical connector used with a sliding track. The connector includes an insulative housing with a mating face for mating a complementary connector, and a loading face opposite to the mating face for assembling the contacts thereto. A sealing plate covers the loading face for waterproofing. Anyhow, because the burrs may be formed on the loading face due to molding, the effect of the waterproofing may be jeopardized.

It is desired to have the electrical connector with a smooth loading surface so as to have the sealing plate intimately attached thereon without minor gaps therebetween.

SUMMARY OF THE INVENTION

An object of the invention is to provide an electrical connector with an insulative housing having a mating face and a loading face opposite to each other. A plurality of partitions are formed in the housing with corresponding passageways in which a plurality of contacts are received. The partition includes a main body and a protrusion extending on the loading face. The protrusion includes a pair of chamfers with a recess in one side to receive the possible burrs due to the injection molding so as to allow the sealing plate intimately cover the loading face with superior waterproofing effect.

Other objects, advantages and novel features of the invention will become more apparent from the following detailed description when taken in conjunction with the accompanying drawings.

DETAILED DESCRIPTION OF THE PREFERRED EMBODIMENT

Figure 1:
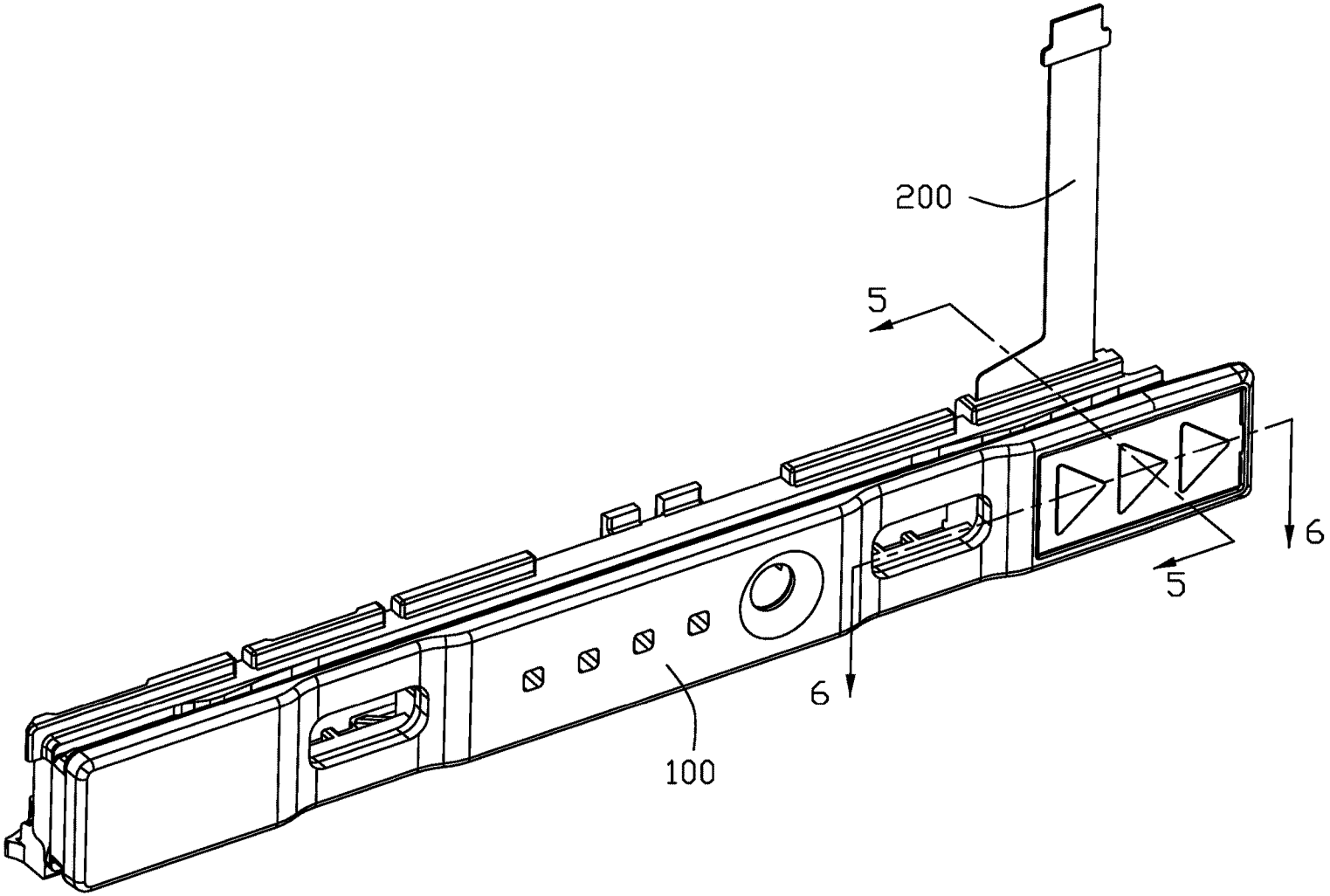
FIG. 1 is a perspective view of the sliding connector assembly of a presently preferred embodiment of the invention.
Figure 2:
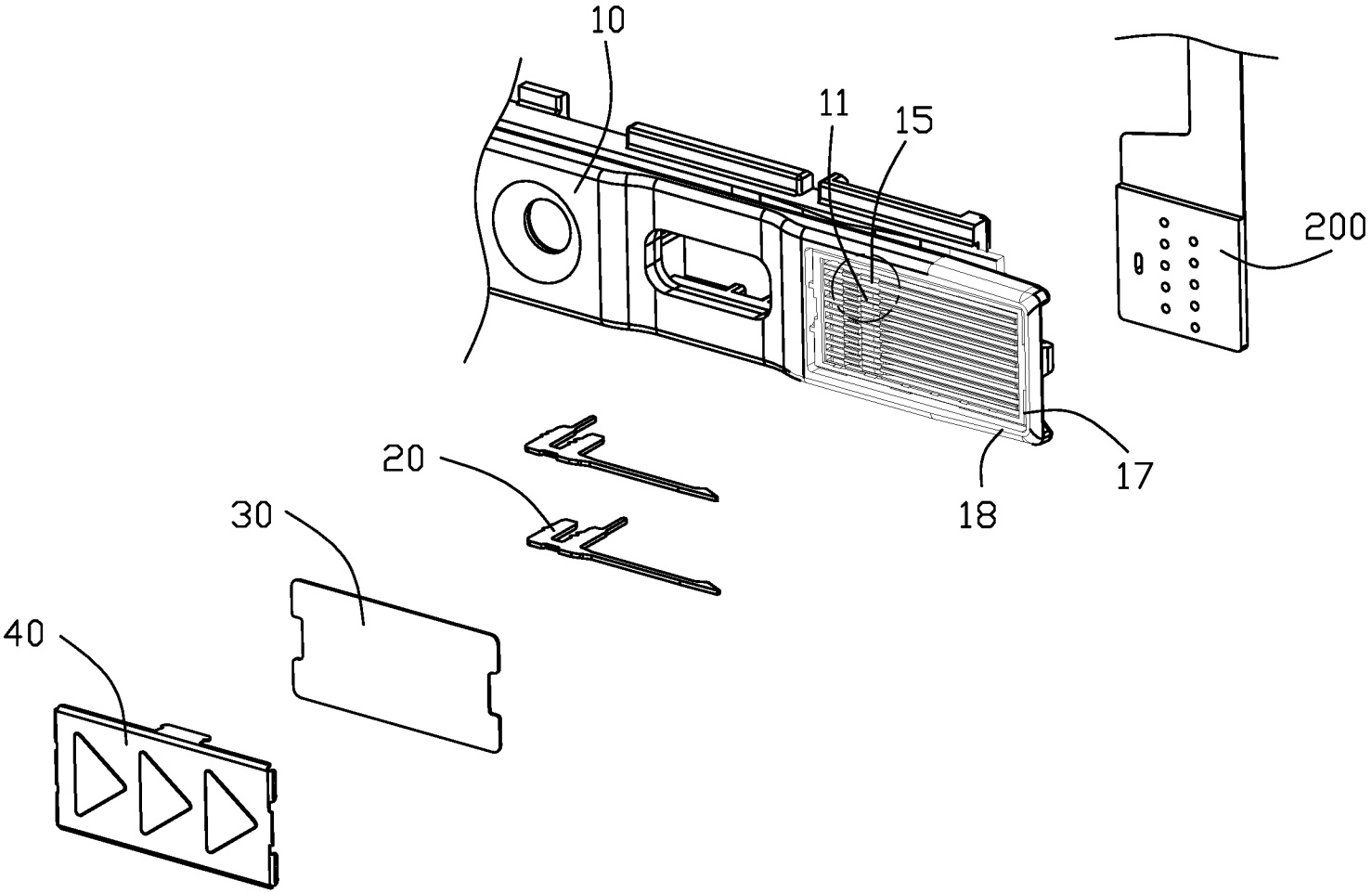
FIG. 2 is an exploded perspective view of a portion of the sliding connector assembly of FIG. 1.
Figure 3:
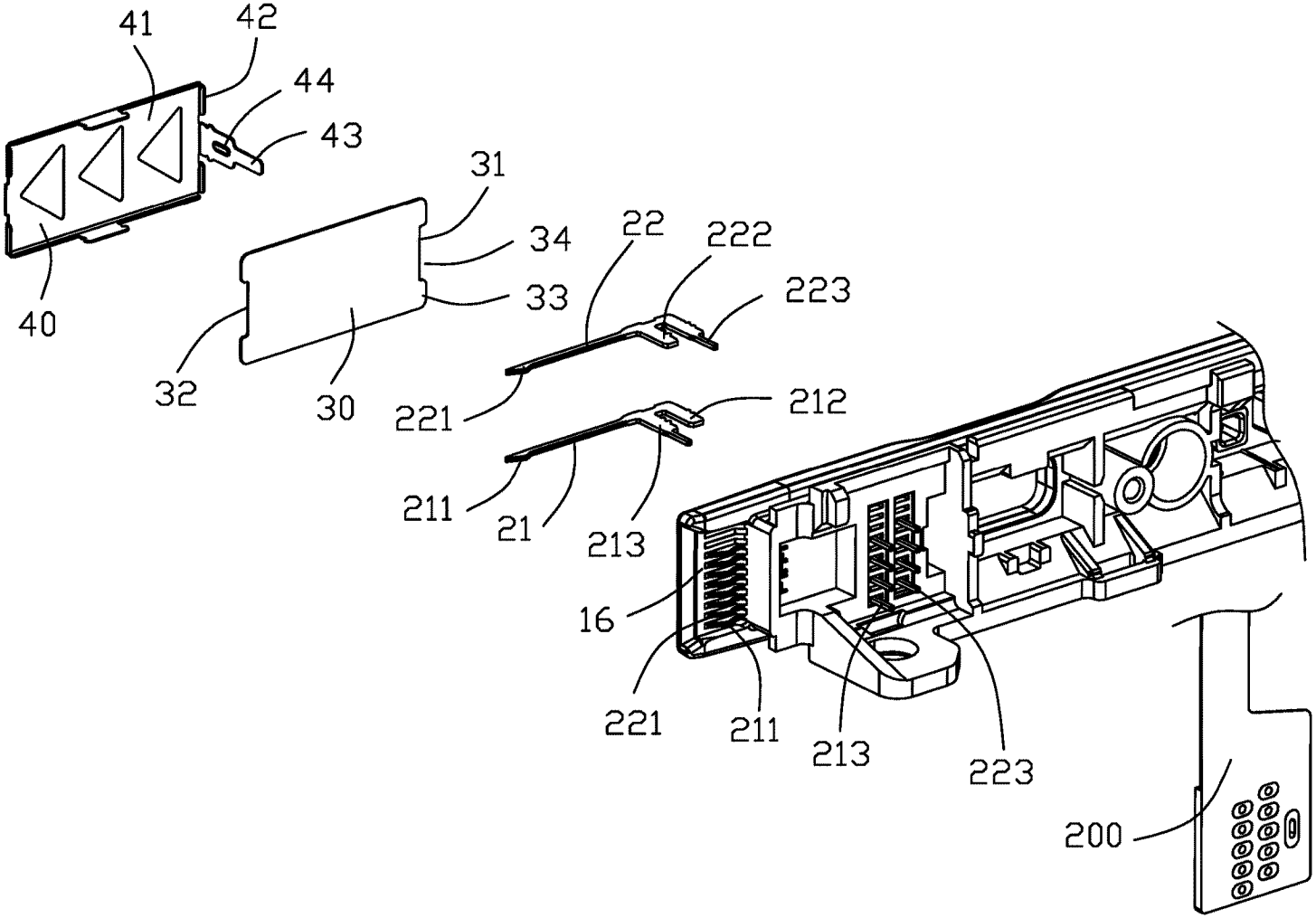
FIG. 3 is another exploded perspective view of the portion of the sliding connector assembly of FIG. 2.
Figure 4:
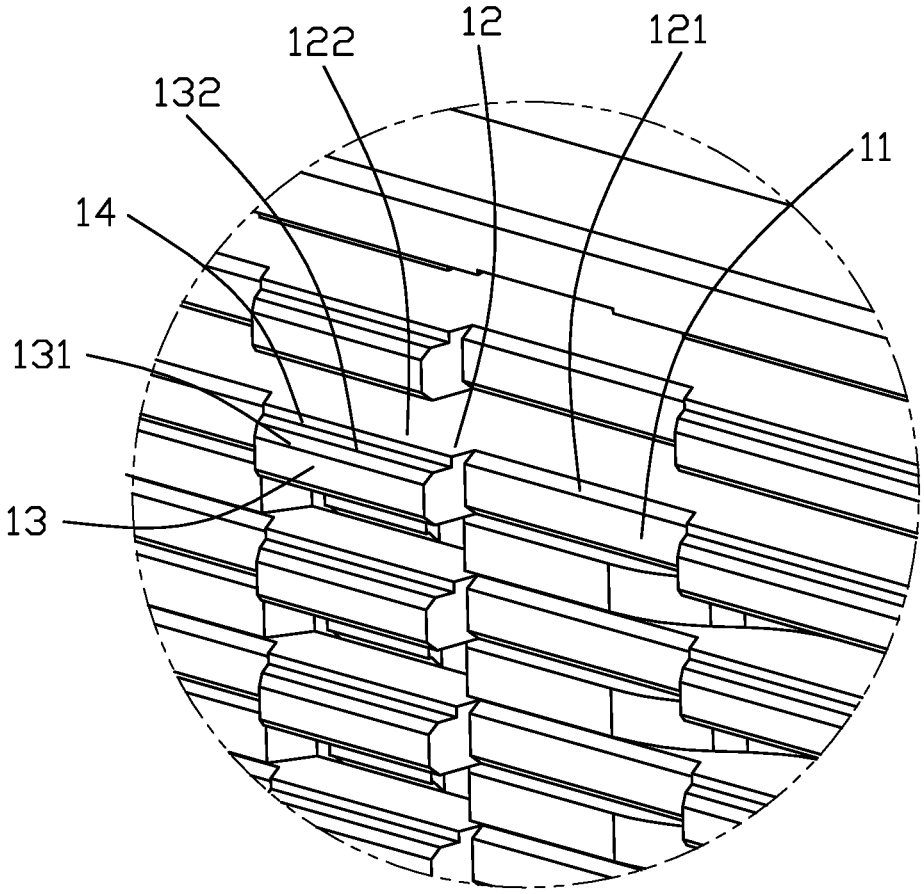
FIG. 4 is an enlarged perspective view of the connector unit of the sliding connector assembly of FIG. 2.
Figure 5:
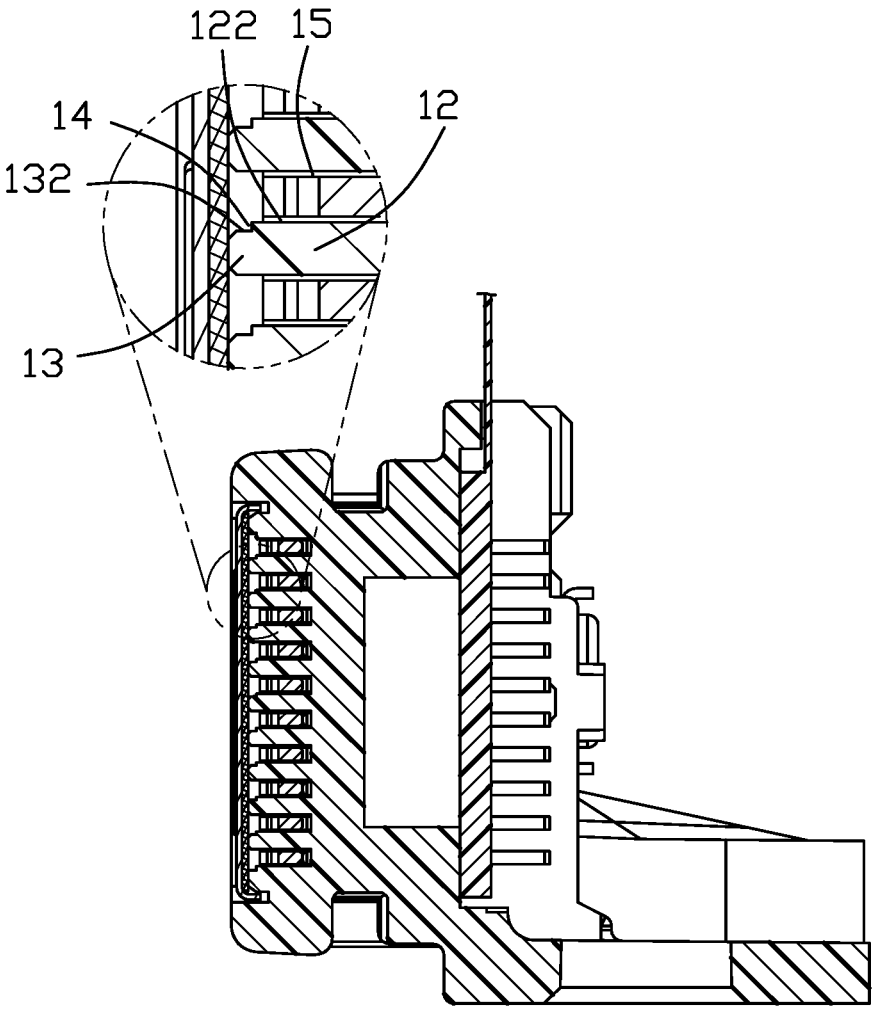
FIG. 5 is a cross-sectional view of the connector unit of the sliding connector assembly of FIG. 2.
Figure 6:
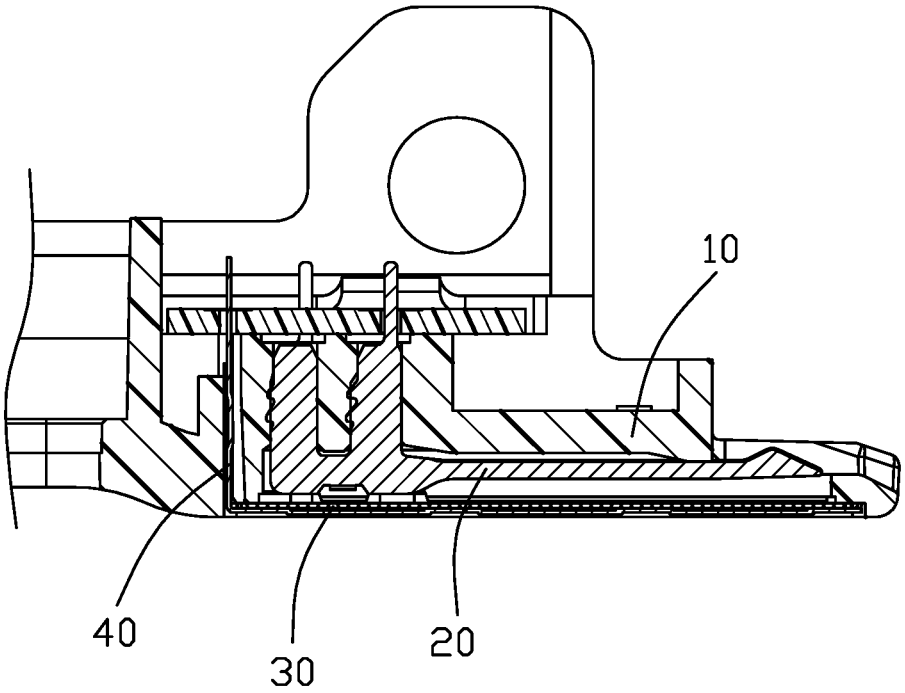
FIG. 6 is another cross-sectional view of the connector unit of the sliding connector assembly of FIG. 2.

Referring to FIGS. 1-6, a sliding connector assembly 100 connected with an FPC (Flexible Printed Circuit) 200 and moveable along a longitudinal direction via the sliding blocks 101 and including a connector unit having an insulative housing 10, a plurality of contacts 20, a sealing plate 30 attached upon the housing 10, and a metallic shell 40. The housing 10 includes a plurality of partitions 11 spaced from one another along a first direction (the transverse direction), and each partition 11 extends in a second direction (the longitudinal direction) perpendicular to the first direction. A contact receiving passageway 15 is formed between every adjacent two partitions 11. The contacts 20 are received within the corresponding passageways 15, respectively. The contacts 20 include a plurality of first contacts 21 and a plurality of second contacts 22 alternately arranged with each other in the first direction. Each first contact 21 includes a horizontal first contacting section 211, a vertical first soldering section 213 and a vertical first retaining section 212 parallel to the first soldering section 213. Similarly, each second contact 22 includes a horizontal second contacting section 221, a vertical second soldering section 223 and a vertical second retaining section 222. The partitions 11 form a mating face 16 and a loading face 17 opposite to each other in a third direction (the vertical direction) perpendicular to both the first direction and the second direction. The first contacting section 211 and the second contacting section 221 protrude out of the mating face 16 in the vertical direction. The first soldering section 213 and the second soldering section 223 protrude out of a mounting face of the housing 10 for mounting to the FPC 200. The housing 10 forms a frame structure 18 in the loading face 17 so as to receive therein the sealing plate 30 for allowing the sealing plate 30 to be intimately seated upon the loading face 17. The sealing plate 30 is rectangular with opposite first edge 31 and second edge 32. Each of the first edge 31 and the second edge 32 forms a pair of projections 33 with a recession 34 therebetween in the first direction. The metallic shell 40 includes a rectangular main part 41 with a locking part 43 extending downwardly from one edge thereof with barbs 44 thereon. The main part 41 further forms a plurality of positioning tabs 42 on opposite edges to abut against the projections 33, respectively. The locking part 43 extends downwardly through the recession 34 and retained within the housing 10 via the barbs 44.

The partition 11 includes a main body 12 and a protrusion 13 on the loading face 17. The protrusion 13 has separated sections wherein the neighboring sections are aligned with one another in the first direction. The main body 12 forms a pair of guiding chamfers 121, and protrusion 13 forms a pair of guiding chamfers 131 as well, so as to allow the corresponding contacts 20 to be easily inserted downwardly into the corresponding passageway 15 from the loading face 17. The main body 12 has a pair of opposite (first) side faces 122 in the first direction, and the protrusion 13 has a pair of opposite (second) side faces 132 in the first direction as well wherein one of the opposite (second) side faces 132 is recessed behind the corresponding (first) side face 122 in the first direction so as to form a recess 14 while the other of the (second) side faces 132 is sill coplanar with the corresponding first side face 122. Understandably, after molding the burrs may be formed on the top face of the protrusion 13 due to removal of the molds. In the invention the recess 14 may receive such unwelcome burrs to allow the sealing plate 30 to be intimately attached upon the top face of the protrusion 13 in the vertical direction without minor gaps therebetween, thus assuring the waterproofing effect thereof. In other words, the width of the passageway 15 defined between two opposite (first/second) side faces 122/132 of the two neighboring partitions 11 is slightly larger than a thickness of the contact 20 while the recess 14 is to accommodate the possible burrs for having such burrs not remaining either on the top face of the protrusion 13 or on the (second) side faces 132 but being dropped within the recess 14.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A sliding connector assembly including:

a sliding blocks extending along a longitudinal direction so as to be moveable along the longitudinal direction;

a connector unit including an insulative housing made by injection molding and having a plurality of partitions spaced from one another in a transverse direction perpendicular to the longitudinal direction, said partitions extending along the longitudinal direction with passageways formed between every adjacent two partitions, respectively;

said partitions forming a mating face and a loading face opposite to each other in a vertical direction perpendicular to both the longitudinal direction and the transverse direction; and a plurality of contacts received within the corresponding passageways, respectively, each of the contacts including a contacting section extending generally in the longitudinal direction and further protruding beyond the mating face in the vertical direction, a retaining section extending in the vertical direction to be retained to the housing so as to allow the contact to be inserted into the corresponding passageway via the loading face in the vertical direction;

wherein each of the partitions includes a main body and a protrusion extending beyond the main body on the loading face, and said protrusion forms a recess in one of opposite side faces thereof adjacent to the loading face for receiving burrs due to molding, so as to allow a sealing plate intimately attached upon the loading face with minor gaps in the vertical direction;

wherein a pair of guiding chamfers are formed on the protrusion of each partition;

wherein the recess is located beside the pair of chamfers in the transverse direction and communicates with one of the pair of chamfers in the transverse direction;

where a pair of guiding chambers are formed on the main body of each partition; and wherein the protrusion of each partition is divided into plural segment in the longitudinal direction.

2. The sliding connector assembly as claimed in claim 1, wherein the each of said contacts further including a soldering section extending in the vertical direction parallel to the retaining section to be soldered to an FPC (Flexible Printed Circuit).

3. The sliding connector assembly as claimed in claim 1, wherein the loading face forms a frame structure to receive the sealing plate therein.

4. The sliding connector assembly as claimed in claim 1, further including a metallic shell covering the sealing plate, wherein the metallic shell is rectangular with positioning tabs on plural edges to abut against periphery of the sealing plate.

5. The sliding connector assembly as claimed in claim 4, wherein the metallic shell includes a locking part extending downwardly in the vertical direction to be retained to the housing.

6. An electrical connector unit comprising:

an insulative housing including a plurality of partitions with corresponding passageways between every adjacent two partitions in a transverse direction, respectively, each of said partitions extending in a longitudinal direction perpendicular to the transverse direction, said partitions defining opposite mating face and loading face in a vertical direction perpendicular to both the transverse direction and the longitudinal direction; and a plurality of contacts received within the corresponding passageway, respectively, each of said contacts including a contacting section protruding downwardly beyond the mating face in the vertical direction, each of said contacts being inserted into the corresponding passageway via the loading face in the vertical direction;

wherein each of said partitions includes a main body and a protrusion extending beyond the main body on the loading face, a pair of side faces are formed in the protrusion, and a recess is formed in one of the side faces adjacent to the loading face for receiving burrs due to molding so as to have one sealing plate intimately attached upon the loading face without minor gaps therebetween in the vertical direction;

wherein a pair of guiding chamfers are formed on the protrusion beside the recess in the transverse direction;

wherein said protrusion is divided into a plurality of segments in the longitudinal direction;

wherein each of said contacts further includes a retaining section extending in the vertical direction; and wherein each of said contacts further includes a soldering section extending in the vertical direction and parallel to the retaining section.

7. The electrical connector unit as claimed in claim 6, wherein a pair of guiding chamfers are formed on the main body.

8. The electrical connector unit as claimed in claim 6, further including a metallic shell covering the sealing plate to cooperate with the loading face for sandwich the sealing plate therebetween in the vertical direction.

9. The electrical connector unit as claimed in claim 6, wherein the housing further includes a mounting face below the mating face through which a soldering section of each contacts extends to be connected to an FPC (Flexible Printed Circuit).

* * * * *